US005147060A

United States Patent [19]

Lima et al.

[11] Patent Number: 5,147,060

[45] Date of Patent: Sep. 15, 1992

[54] SAFETY CONTAINER

[75] Inventors: William Lima, Monmouth Beach; Earl V. Lind, Brick; Philip D. Bartlett, Holmdel, all of N.J.; Michael R. McGrath, Colton, Calif.

[73] Assignee: Russell-Stanley Corporation, Red Bank, N.J.

[21] Appl. No.: 786,394

[22] Filed: Nov. 1, 1991

[51] Int. Cl.[5] ..... B65D 41/04

[52] U.S. Cl. ..... 220/288; 220/326; 215/216; 215/221

[58] Field of Search ..... 220/288, 315, 323, 324, 220/326; 215/221, 216

[56] References Cited

U.S. PATENT DOCUMENTS

| | | | |
|---|---|---|---|
| 3,894,647 | 7/1975 | Montgomery . | |
| 3,902,620 | 9/1975 | McIntosh | 215/209 |
| 3,917,097 | 11/1975 | Uhlig | 215/216 |
| 3,951,290 | 4/1976 | Montgomery | 215/219 |
| 4,036,385 | 7/1977 | Morris | 215/209 |
| 4,105,132 | 8/1978 | Keeler | 215/216 |
| 4,144,983 | 3/1979 | Pauls et al. | 215/216 |
| 4,298,132 | 11/1981 | Galer | 220/288 |
| 4,456,136 | 6/1984 | Pálsson | 215/216 |
| 4,512,484 | 4/1985 | Mar | 215/221 |
| 4,548,329 | 10/1985 | Curry | 215/216 |
| 4,687,112 | 8/1987 | Swartzbaugh | 215/216 |
| 4,732,288 | 3/1988 | Morris, Sr. | 215/214 |
| 4,967,926 | 11/1990 | Morris, Sr. | 220/323 |
| 4,991,733 | 2/1991 | Marino | 215/330 |

*Primary Examiner*—Stephen Marcus
*Assistant Examiner*—Nova Stucker
*Attorney, Agent, or Firm*—Hedman, Gibson & Costigan

[57] ABSTRACT

A safety container having an array of ratchet teeth cooperating with a pawl stop is provided. The cover of the container can only be removed by counterclockwise rotation while the pawl is urged out of engagement with the ratchet teeth.

4 Claims, 2 Drawing Sheets

SAFETY CONTAINER

FIELD OF THE INVENTION

The invention relates to resealable containers. More particularly, the invention relates to resealable safety containers intended for opening by adults but not by infants.

BACKGROUND OF THE INVENTION

Safety containers have long been desirable to provide selective storage of materials. Recently, a great deal of attention has been directed to the development of tamper-proof, tamper-resistant and child proof containers. A typical objective of safety containers is to provide a means by which adults can gain access to the contents of the safety container, but prevent children from gaining the same access.

Accordingly, safety container closures have been designed that depend on strength, finger length and acumen or experience to open the closure.

Various closures have been developed that rely on ratchet structures to facilitate secure closure of a safety container. However, the ratchet structures generally function with a ratchet pawl that can be moved into and out of engagement with the ratchet teeth with minimal force.

SUMMARY OF THE INVENTION

It is an objective of the subject invention to provide a safety container that can be easily opened by adults but not by children.

It is another objective of the invention to provide a safety container closure that requires a combination of cognitive faculties and strength to remove the closure from the container.

To these ends, a safety container has been provided that comprises a circular opening on the container, a peripheral ratchet array on the exterior of the container opening and a closure adapted to cooperate with the peripheral ratchet array. The container also comprises pitched threads disposed on the periphery of the opening. The closure has mating pitched threads on the closure interior. In addition, the closure is provided with a stop in the form of a ratchet pawl with means to release the ratchet from the ratchet teeth. The pawl is designed to constantly bear against the ratchet teeth and facilitate release of the ratchet lock only when a force is maintained on the pawl while the closure is being opened.

DESCRIPTION OF THE DRAWINGS

The invention will be better understood when considered with the following drawings wherein.

DESCRIPTION OF THE PREFERRED EMBODIMENT

The subject invention has application in various environments in which safe resealable containers are required. However, the invention will be described in the environment of a swimming pool chemical container, typically used to store chlorine or chlorine tablets.

Figure 1:
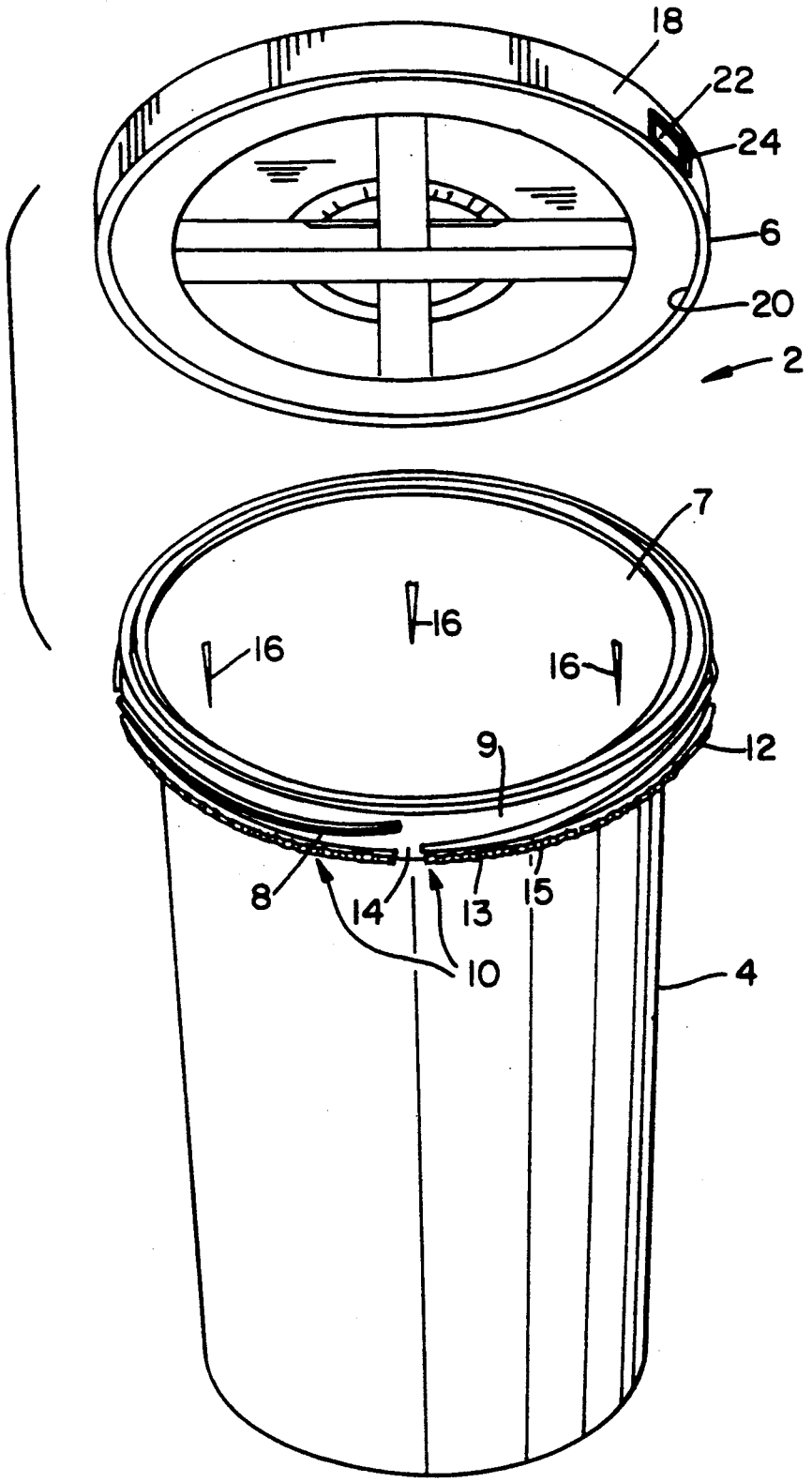
FIG. 1 is on exploded isometric drawing of the safety container of the subject invention.

As best seen in FIG. 1, the safety container 2 is comprised of a bucket section 4 and a closure cover 6.

The bucket section 4 has the customary top opening 7. Four equally spaced pitched threads 8 are arranged on the exterior surface at the top of the bucket section 4 and a peripheral array 10 of ratchet teeth 12 is formed on the exterior of the bucket 4 at a location that insures registry with the lower edge of the cover 6 when the cover 6 is secured to the bucket 4.

Each ratchet tooth 12 is comprised of an inclined surface 13 and a flat wall 15. Although, the array of ratchet teeth 12 can be continuous, the array 10 of ratchet teeth 12 depicted in FIG. 1 is interrupted at four equidistant locations by separations 14 that align vertically with the respective separations between the leading and trailing edges of the threads 8. In one embodiment, the bucket 4 is provided with a rim 9 depending downwardly from the bucket opening 7 on which the pitched threads 8 and array 10 of ratchet teeth 12 are formed.

The bucket 4 also includes a plurality of antinesting indentations 16 on the interior surface of the bucket 4.

Figure 2:
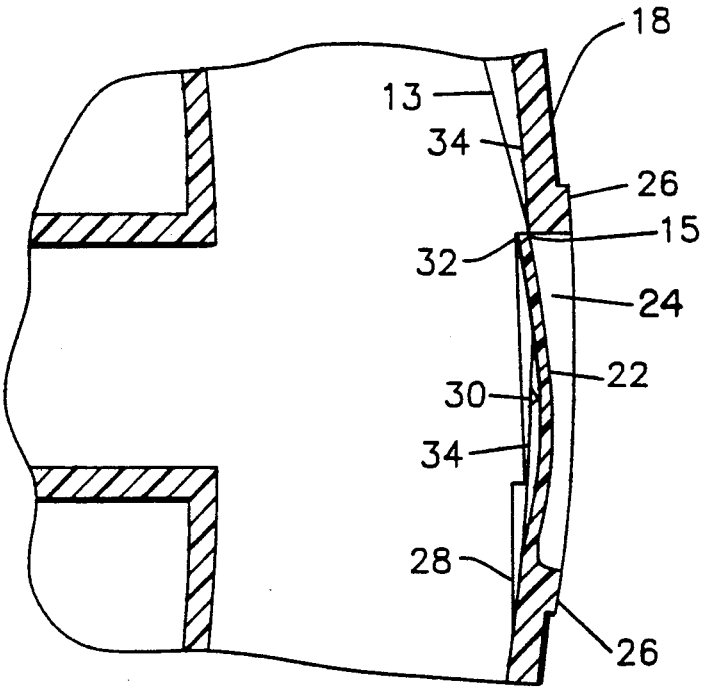
FIG. 2 is a partial sectional plan view of the ratchet pawl of the closure.

The cover 6 is provided with a conventional depending rim 18 on which four internally directed threads 20 are formed. The threads 20 have the same pitch as the threads 8 on the surface of the bucket 4. In addition, as best seen in FIGS. 2 and 3, a pawl or stop 22 is formed in an opening 24 in the wall 26 of the depending rim 18.

The pawl stop 22 connects to the wall 26 by means of a living hinge 28 to provide a cantilever effect. A vertical post 30 secured to the top and bottom of the opening 24 is provided to cooperate with the pawl stop 22 to facilitate release of the cover 6. The leading edge 32 of the pawl stop 22 extends inwardly beyond the inner surface 34 of the depending rim 18.

In operation, the cover 6 is secured to the bucket 4 by clockwise rotation of the threads 20 on the threads 8. As the cover 6 moves downwardly on the threads 8 and 20, the array 10 of ratchet teeth 12 comes into registry with the pawl stop 22. The ratchet teeth 12 travel over the leading edge 32 of the pawl stop 22 until the cover 6 is securely attached to the bucket 4. The leading edge 32 of the pawl stop 22 bears on the inclined surfaces 13 of the ratchet teeth 12 during the tightening of the cover 6. However, upon reversal of the rotation of the cover 6 the leading edge 32 of the pawl stop 22 bears against the flat wall 15 of one of the ratchet teeth 12 thereby preventing reverse rotation of the cover 6. The location of the vertical post 30 at an intermediate point between the hinge 28 and the leading edge 32 of the stop 22 provides a support that prevents deflection of the stop 22 when a counter clockwise force is imposed on the cover 6, thereby insuring the locked condition.

Figure 3:
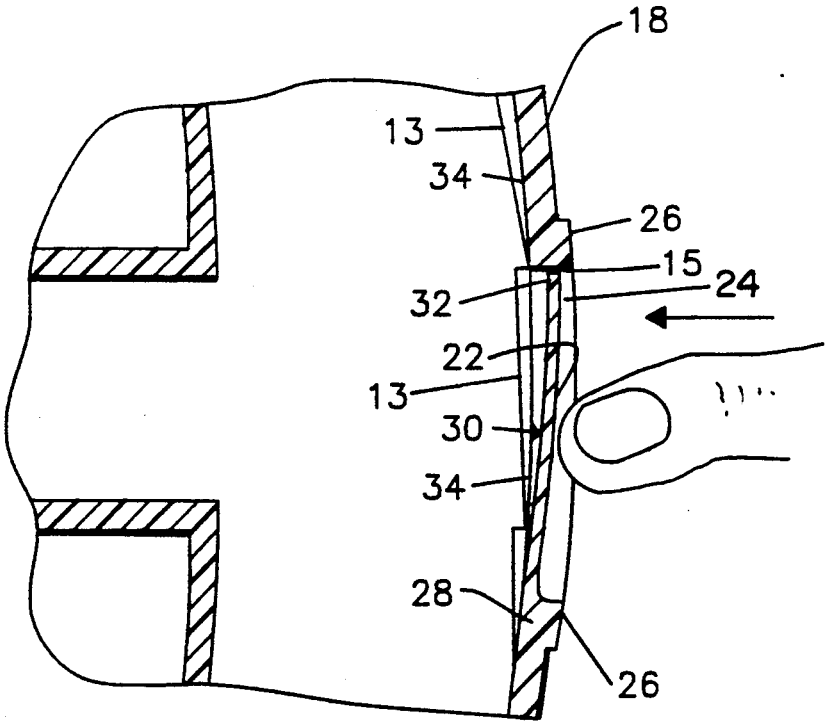
FIG. 3 is a view of the assembly of FIG. 2 with a transverse force imposed on the ratchet pawl to disengage the pawl from the ratchet teeth.

As best seen in FIG. 3, removal of the cover 6 from the bucket 4 can only occur when a inward transverse force is imposed on the pawl stop 22 between the hinge 28 and the post 30 to urge the leading edge 32 of the pawl stop 22 outwardly around the post 30. Thus, if one person is attempting to remove the cover 6 only one hand will be available to rotate the cover 6 in the counterclockwise direction; the other hand being required to maintain the inward transverse force on the pawl stop 22.

In practice, it has been found that a bucket 4 and cover 6 made of high density polyethylene typically used for swimming pool chemical containers can be provided with the safety lock assembly of this invention when the pawl stop 22 is about one-half inch high; 0.050 inch thick; 0.750 inch long and the leading edge 38 is oriented to extend about 0.040 inch inwardly beyond the interior of the cover rim. The post 30 is 0.30 inch wide tapering to a bearing surface of about 0.10 inch and is located about one-half inch from the hinge 28. The ratchet teeth are about one-half inch in length between flat walls 15 and the depth of the flat walls 15 is about 0.040 inch.

We claim:

1. A safety closure assembly comprising;

a) a bucket having a circular opening;

b) a pitched thread on the exterior of the circular opening on the bucket;

c) a cover having a depending rim sized to fit the bucket opening;

d) a pitched thread on the interior of the depending rim of the cover;

e) ratchet teeth on the outer periphery of the bucket opening;

f) means on the cover for cooperating with the ratchet teeth to enable uninhibited securement of the cover to the bucket and to prevent removal of the cover without the constant application of force on said means comprising;

i) a ratchet pawl stop having a leading edge that extends beyond the interior surfaces of the cover into engagement with the ratchet teeth on the periphery of the bucket opening when the cover is secured to the bucket; and ii) a means for removing the leading edge of the ratchet pawl stop from engagement with the ratchet teeth comprising a hinge at the end of the ratchet pawl stop opposite the leading edge of the ratchet pawl stop; a post located at an intermediate position between the hinge and the leading edge of the ratchet pawl stop; whereby the inner surface of the ratchet pawl stop bears against said post and force applied to the exterior surface of the stop between said hinge and said post rotates with the leading edge of the ratchet pawl stop out of engagement with the ratchet teeth; and g) a depending rim on the exterior of the bucket opening on which said thread and ratchet teeth are mounted.

2. A safety closure assembly as in claim 1 wherein the ratchet teeth are formed in four separate horizontally aligned arrays.

3. A safety closure assembly as in claim 2 wherein the hinge is a living hinge.

4. A safety closure assembly as in claim 3 further comprising means to prevent nesting of the buckets.

* * * * *